US007723594B2

(12) United States Patent
Hong

(10) Patent No.: US 7,723,594 B2
(45) Date of Patent: May 25, 2010

(54) DRUM WITH SECTIONAL SHELL, SECTIONS JOINED BY MAGNETS

(75) Inventor: G-Hong Hong, Taipei (TW)

(73) Assignee: Taiwan Falum Dafa Society, Taipei (TW)

( * ) Notice: Subject to any disclaimer, the term of this patent is extended or adjusted under 35 U.S.C. 154(b) by 0 days.

(21) Appl. No.: 12/081,097

(22) Filed: Apr. 10, 2008

(65) Prior Publication Data

US 2009/0158913 A1 Jun. 25, 2009

(30) Foreign Application Priority Data

Dec. 25, 2007 (TW) ..... 96149892 A

(51) Int. Cl.
*G10D 13/02* (2006.01)

(52) U.S. Cl. ..... 84/412; 84/411 R

(58) Field of Classification Search ..... 84/412, 84/411 R

See application file for complete search history.

(56) References Cited

U.S. PATENT DOCUMENTS 3,827,021 A * 7/1974 Phelon ..... 335/285
4,779,509 A * 10/1988 Weir ..... 84/421
5,760,668 A * 6/1998 Testa et al. ..... 335/285
5,957,421 A * 9/1999 Barbour ..... 248/220.21
6,121,528 A * 9/2000 May ..... 84/411 R
6,172,289 B1 * 1/2001 Shelley ..... 84/411 R
6,686,526 B2 * 2/2004 Ezbicki ..... 84/411 R
6,686,527 B2 * 2/2004 Hagiwara ..... 84/413

* cited by examiner

*Primary Examiner*—Jeffrey Donels
*Assistant Examiner*—Robert W Horn
(74) *Attorney, Agent, or Firm*—Bacon & Thomas, PLLC

(57) ABSTRACT

A drum of the present invention comprises: a shell having a plurality of shell members, wherein the upper rim of the shell is provided with a first magnetic component, and wherein the lower rim of the shell is provided with a second magnetic component; a first drumhead provided with a third magnetic component corresponding to the first magnetic component; and a second drumhead provided with a fourth magnetic component corresponding to the second magnetic component. The shell members use a first joining component and a second joining component to be joined with one another so as to form the shell. Furthermore, by magnetism between the first magnetic component and the third magnetic component and magnetism between the second magnetic component and the fourth magnetic component, the first drumhead, the second drumhead and the shell can be joined with one another. A drum of the present invention is advantageous in that it is easy to assemble and disassemble the drum, and accordingly, it is highly convenient whether to carry or to transport the drum.

10 Claims, 15 Drawing Sheets

DRUM WITH SECTIONAL SHELL, SECTIONS JOINED BY MAGNETS

BACKGROUND OF THE INVENTION

1. Field of the Invention

This invention relates generally to a drum, and more particularly, to a drum that is easy to assemble and disassemble and that is easy to carry accordingly.

2. Description of the Related Art

As life in modern times gets complex, people are spending more and more time for leisure than for work. Modern people are demanding a satisfactory spiritual life as well as a satisfactory material life. For people pursuing a good spiritual life, listening to music is one of the most common interests or enjoyments since music may relieve stress and help to improve health.

Drums are very common among musical instruments in the world. It is common to see drums in concerts or religious rituals. As an important type of musical instrument, drums are often used in activities that prefer the performance of percussion music, such as religious activities. Drums suit well with other percussion instruments, delivering a passionate or cheerful, lively mood in the activities.

Drums need to be brought to places where activities are held; however, conventional drums are generally not convenient to transport. Bigger drums are heavy and consume a lot of space; smaller drums may be lighter, but they consume much space as well when many of them are transported at one time. Usually, a conventional drum is made one-piece with its drumhead connecting to its shell and may not be dismantled into parts before transportation. This causes inconveniences for users to carry or to transport drums. Therefore, it is needed to overcome this disadvantage for prior art drums.

SUMMARY OF THE INVENTION

The object of the present invention is to provide a drum. Through the use of a first joining component and a second joining component, each of a plurality of shell members is joined with one another and a shell can thus be formed. Then, by magnetism associated with a first magnetic component and with a second magnetic component, a first drumhead and a second drumhead can be joined with the shell of the drum. A drum formed in such manner is easy to assemble and disassemble, and therefore, it is highly convenient whether to carry or to transport the drum.

To achieve the objective described above, a drum of the present invention comprises: a shell having a plurality of shell members, wherein each shell member can be joined with one another to form the cylindrical shell, which has an upper rim provided with at least one first magnetic component and a lower rim provided with at least one second magnetic component; a first drumhead provided with a third magnetic component which corresponds in location to the first magnetic component of the shell so that the two magnetic components can be coupled together; and a second drumhead provided with a fourth magnetic component which corresponds in location to the second magnetic component of the shell so that the two magnetic components can be coupled together, wherein the shell members use a first joining component and a second joining component to be joined with one another so as to form the shell, and wherein by magnetism between the first magnetic component and the third magnetic component and magnetism between the second magnetic component and the fourth magnetic component, the first drumhead, the second drumhead and the shell can be joined with one another.

Preferably, the first magnetic component and the second magnetic component are provided with a securing post each; the third magnetic component is provided with a securing hole corresponding to the securing post of the first magnetic component; the fourth magnetic component is provided with a securing hole corresponding to the securing post of the second magnetic component.

Preferably, the upper rim and the lower rim of the shell are provided with a securing post each; the first drumhead and the second drumhead are each provided with a securing hole corresponding to the securing post of the shell.

Preferably, the first magnetic component and the third magnetic component are both magnets.

Preferably, the second magnetic component and the fourth magnetic component are both magnets.

Preferably, the first magnetic component is secured at the upper rim of the shell through the use of a third joining component along with a fourth joining component. The second magnetic component is secured at the lower rim of the shell through the use of the third joining component along with the fourth joining component.

Preferably, the shell member is provided with an aperture.

Preferably, the shell member further comprises a ring and a foldable sheet. The foldable sheet pierces through the ring first and then through the aperture so that the ring can be fixed outside the aperture of the shell member.

In another embodiment, a drum of the present invention comprises: a shell having a plurality of shell members, wherein each shell member can be joined with one another to form the cylindrical shell, which has an upper rim provided with at least one first opening and a lower rim provided with at least one second opening; a first drumhead provided with an L-shaped rod which corresponds in location to the first opening of the shell; and a second drumhead provided with an L-shaped rod which corresponds in location to the second opening of the shell, wherein the shell members use a first joining component and a second joining component to be joined with one another so as to form the shell, and wherein when a user covers the upper and lower rims of the shell with the first and second drumheads respectively and rotates them a bit, the L-shaped rods can be secured to the first and second openings respectively so that the first drumhead, the second drumhead and the shell can be joined with one another.

Preferably, the shell member is provided with an aperture. Preferably, the shell member further comprises a ring and a foldable sheet. The foldable sheet pierces through the ring first and then through the aperture so that the ring can be fixed outside the aperture of the shell member.

In another embodiment, a drum of the present invention comprises: a shell having a plurality of shell members, wherein each shell member can be joined with one another to form the cylindrical shell, which has an upper rim provided with at least one first opening, close to which at least one first magnetic component is provided, and a lower rim provided with at least one second opening, close to which at least one second magnetic component is provided; a first drumhead provided with an L-shaped rod which corresponds in location to the first opening of the shell, wherein a third magnetic component is provided close to the L-shaped rod; and a second drumhead provided with an L-shaped rod which corresponds in location to the second opening of the shell, wherein a fourth magnetic component is provided close to the L-shaped rod, wherein the shell members use a first joining component and a second joining component to be joined with one another so as to form the shell, wherein when a user covers the upper and lower rims of the shell with the first and second drumheads respectively and rotates them a bit, the L-shaped rods can be secured to the first and second openings respectively, and wherein by magnetism between the first magnetic component and the third magnetic component and magnetism between the second magnetic component and the fourth magnetic component, the first drumhead, the second drumhead and the shell can be joined with one another.

In yet another embodiment, a drum of the present invention comprises: a shell having a plurality of shell members, wherein each shell member is provided with a dovetail slot and a dovetail protrusion at two opposite ends, and is provided with a male thread at each of another two opposite ends; a first drumhead, the inner wall of which is provided with female threads corresponding to the male threads of the shell members; and a second drumhead, the inner wall of which is provided with female threads corresponding to the male threads of the shell members, wherein the shell members use a dovetail slot and a dovetail protrusion to be joined with one another so as to form the shell, and wherein by coupling the female threads of the first drumhead to the male threads of the shell member and by coupling the female threads of the second drumhead to the male threads of the shell member, the first drumhead, the second drumhead and the shell can be joined with one another.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
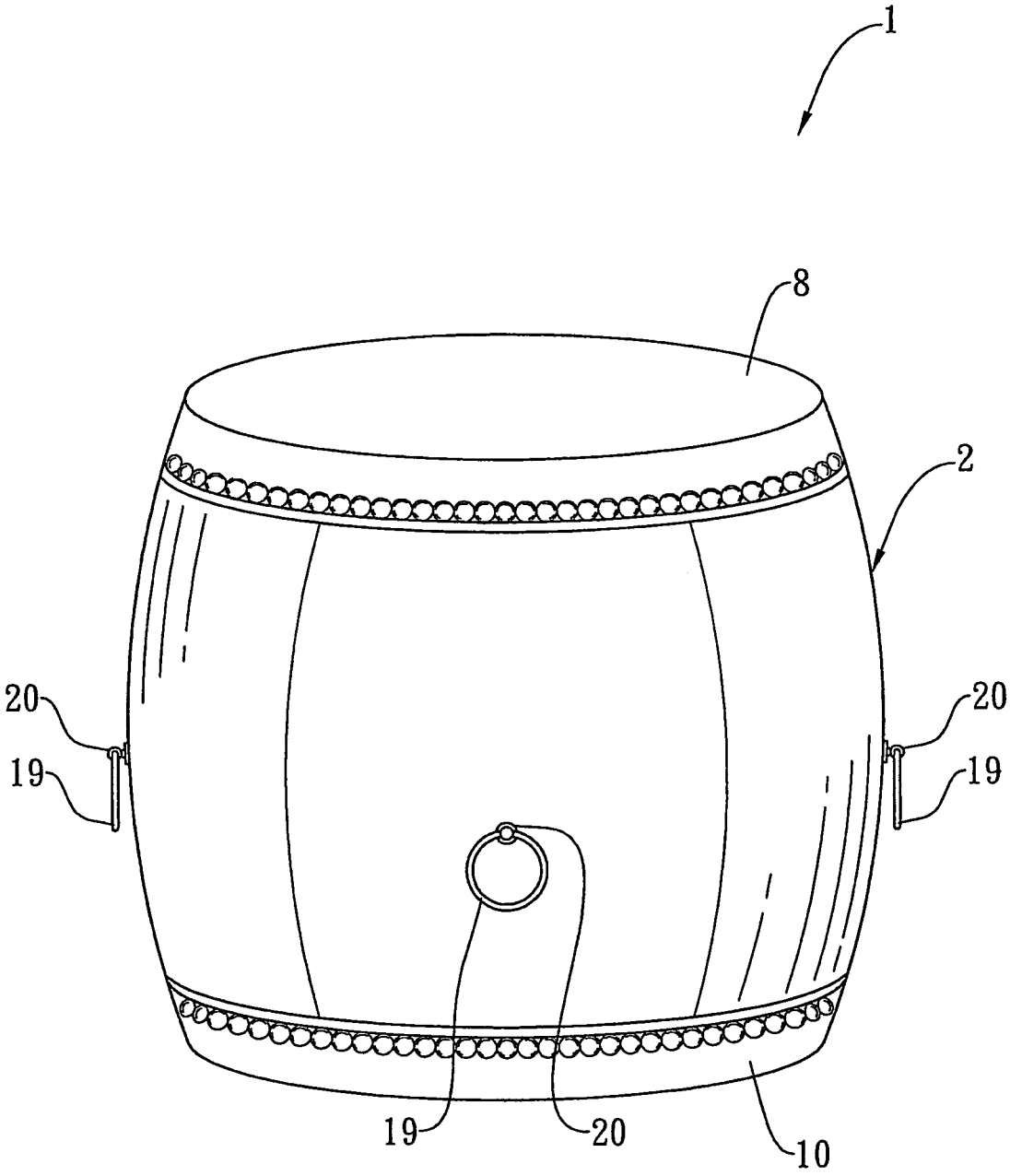
FIG. 1 shows a perspective view of a drum according to a first embodiment of the present invention.
Figure 2:
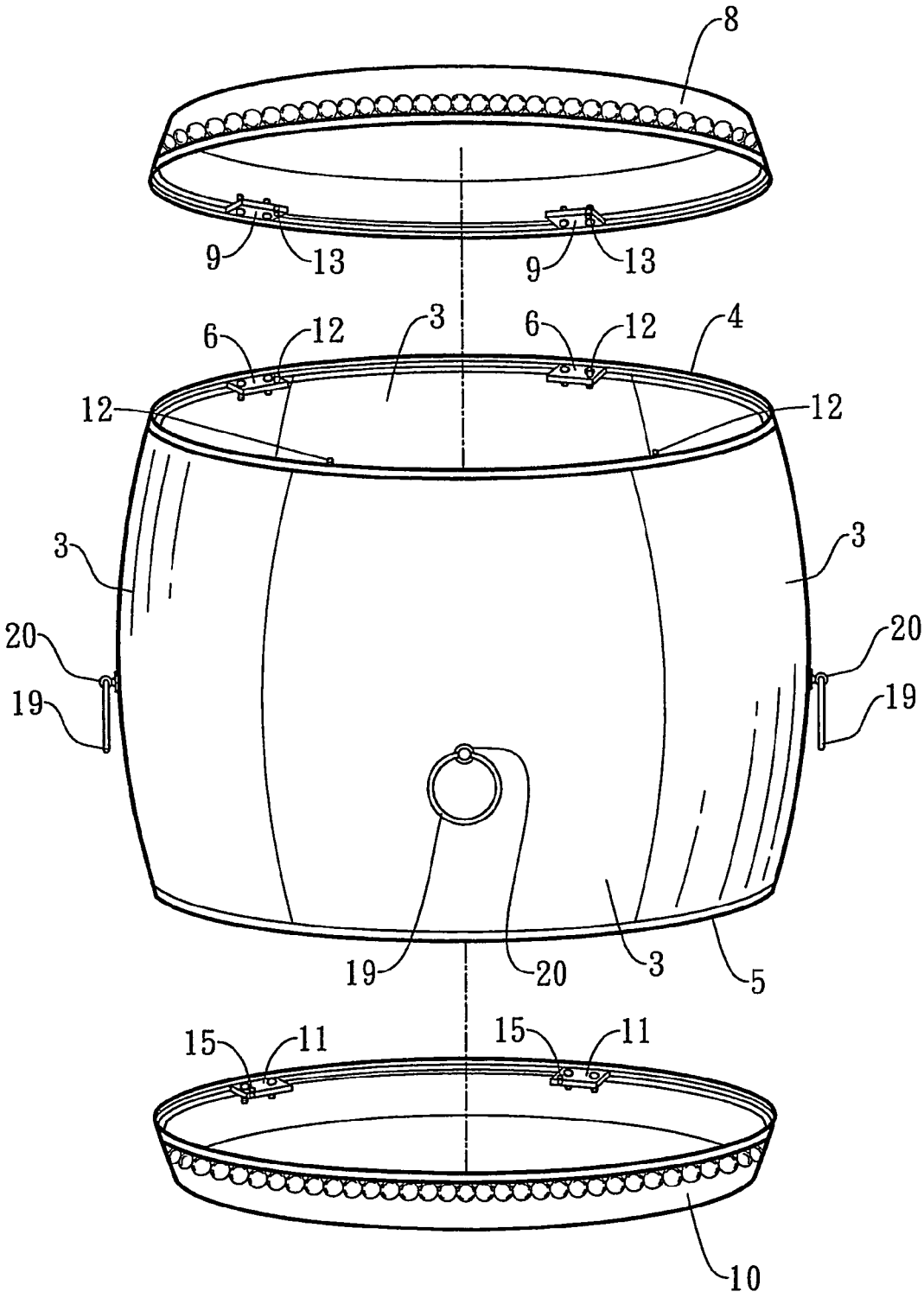
FIG. 2 shows an exploded view of the drum according to the first embodiment of the present invention.

Referring to FIGS. 1 and 2, a perspective view and exploded view of a drum 1 are shown respectively, according to a first embodiment of the present invention. In this embodiment, the drum 1 comprises a shell 2, a first drumhead 8, and a second drumhead 10. The shell 2 has a plurality of shell members 3. Each shell member 3 can be joined with one another, and the cylindrical shell 2 can be formed when all of the shell members 3 are assembled together. The shell 2 includes an upper rim 4 provided with at least a first magnetic component 6, and a lower rim 5 provided with a second magnetic component 7. The first drumhead 8 of the drum 1 is provided with a third magnetic component 9 corresponding in location to the first magnetic component 6 of the shell 2 so that the third magnetic component 9 of the first drumhead 8 can be coupled to the first magnetic component 6. The second drumhead 10 of the drum 1 is provided with a fourth magnetic component 11 corresponding in location to the second magnetic component 7 of the shell 2 so that the fourth magnetic component 11 can be coupled to the second magnetic component 7.

Figure 2B:
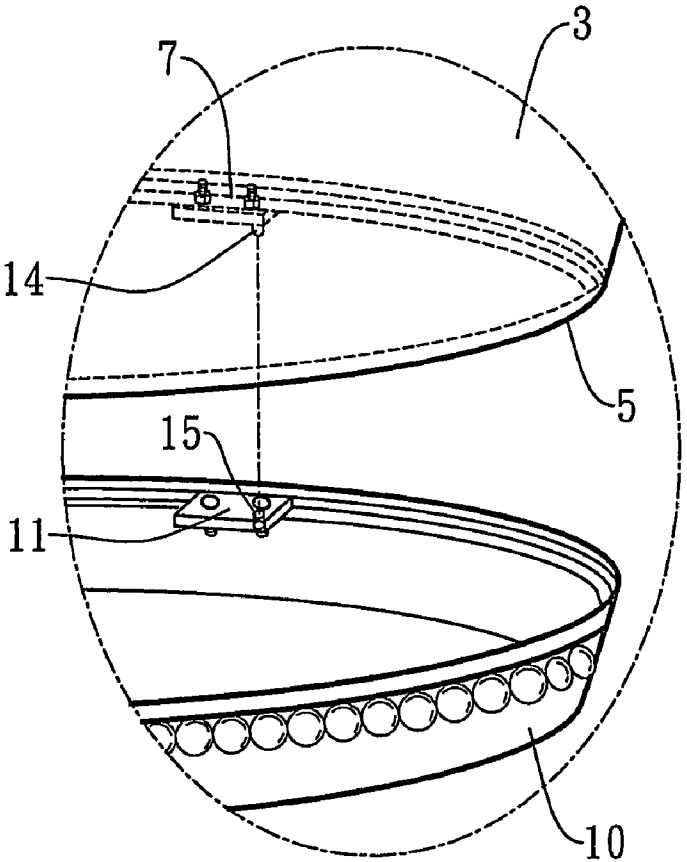
FIG. 2B shows a schematic view of joining the second drumhead with the shell according to the first embodiment of the present invention.
Figure 2A:
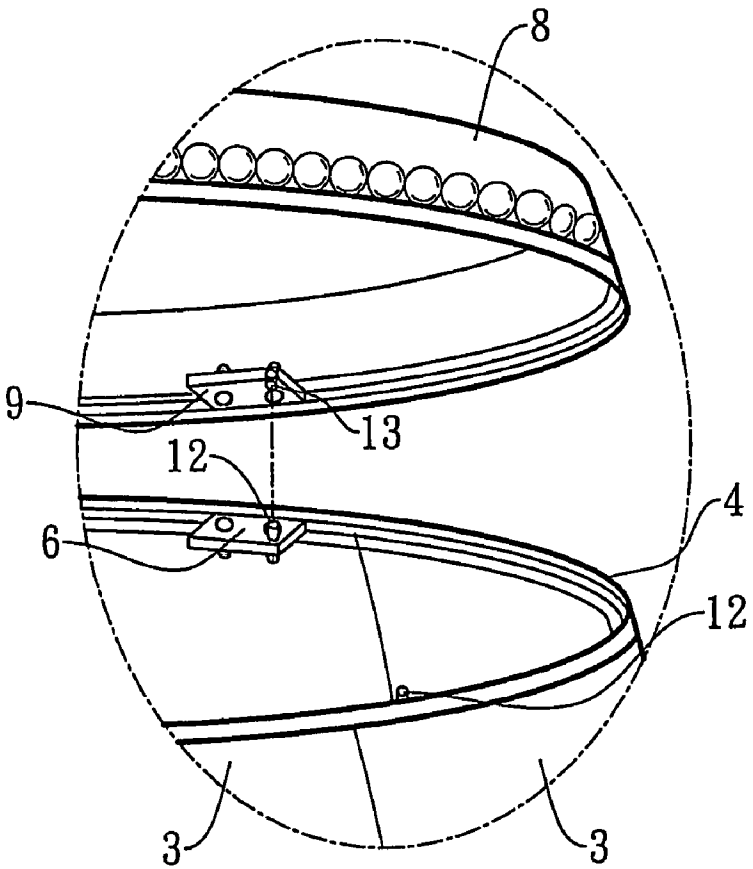
FIG. 2A shows a schematic view of joining the first drumhead with the shell according to the first embodiment of the present invention.

Referring to FIG. 2A, a schematic view of joining the first drumhead 8 with the shell 2 is shown. The first magnetic component 6 is provided with a securing post 12, and the third magnetic component 9 is provided with a securing hole 13 corresponding in location to the securing post 12. The securing hole 13 and the securing post 12 serve to secure the position of both the third magnetic component 9 of the first drumhead 8 and the first magnetic component 6 of the shell 2, when the two magnetic components are coupled together.

Referring to FIG. 2B, a schematic view of joining the second drumhead 10 with the shell 2 is shown. The second magnetic component 7 is provided with a securing post 14, and the fourth magnetic component 11 is provided with a securing hole 15 corresponding in location to the securing post 14. The securing hole 15 and the securing post 14 serve to secure the position of both the fourth magnetic component 11 of the second drumhead 10 and the second magnetic component 7 of the shell 2, when the two magnetic components are coupled together.

Figure 3:
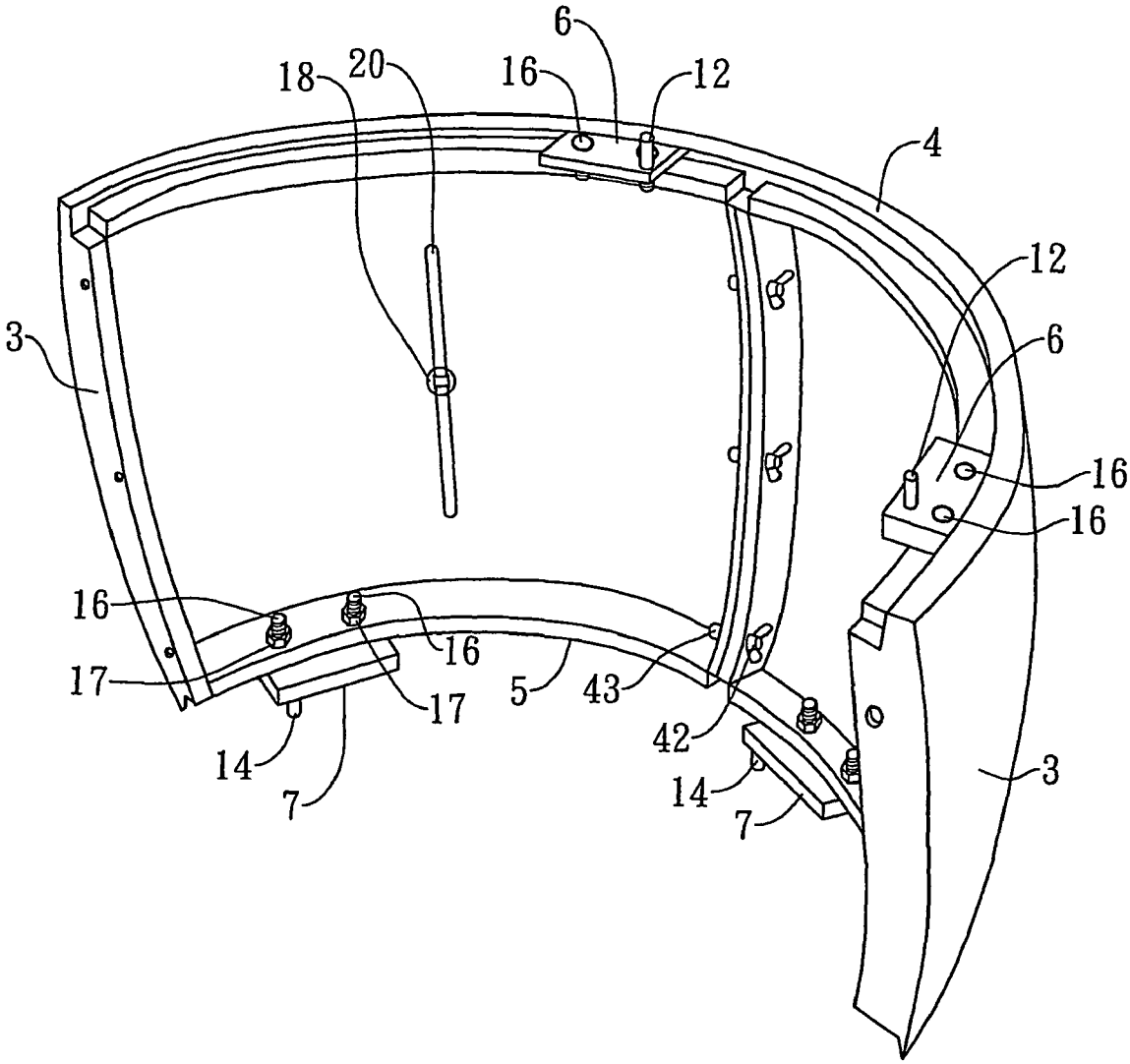
FIG. 3 shows a schematic view of assembling the shell members according to the first embodiment of the present invention.

Referring to FIG. 3 along with FIG. 2, FIG. 3 shows a schematic view of assembling the shell members 3 of the drum 1 according to the first embodiment of the present invention. The shell members 3 use a first joining component 42 and a second joining component 43 to be joined with one another and form the shell 2 together. Further, the first drumhead 8 is joined to the top of the shell 2 by magnetism between the first magnetic component 6 and the third magnetic component 9, and the second drumhead 10 is joined to the bottom of the shell 2 by magnetism between the second magnetic component 7 and the fourth magnetic component 11.

More specifically, the first magnetic component 6 is secured at the upper rim 4 of the shell 2 through the use of a third joining component 16 along with a fourth joining component 17. Likewise, the second magnetic component 7 is secured at the lower rim 5 of the shell 2 through the use of the third joining component 16 along with the fourth joining component 17. The first magnetic component 6 and the third magnetic component 9 are both magnets; also, the second magnetic component 7 and the fourth magnetic component 11 are both magnets.

Each shell member 3 is provided with an aperture 18, and the drum 1 of the present invention further comprises a ring 19 and a foldable sheet 20. The foldable sheet 20 pierces through the ring 19 first and then through the aperture 18 so that the ring 19 can be fixed outside the aperture 18 of the shell member 3.

Figure 4:
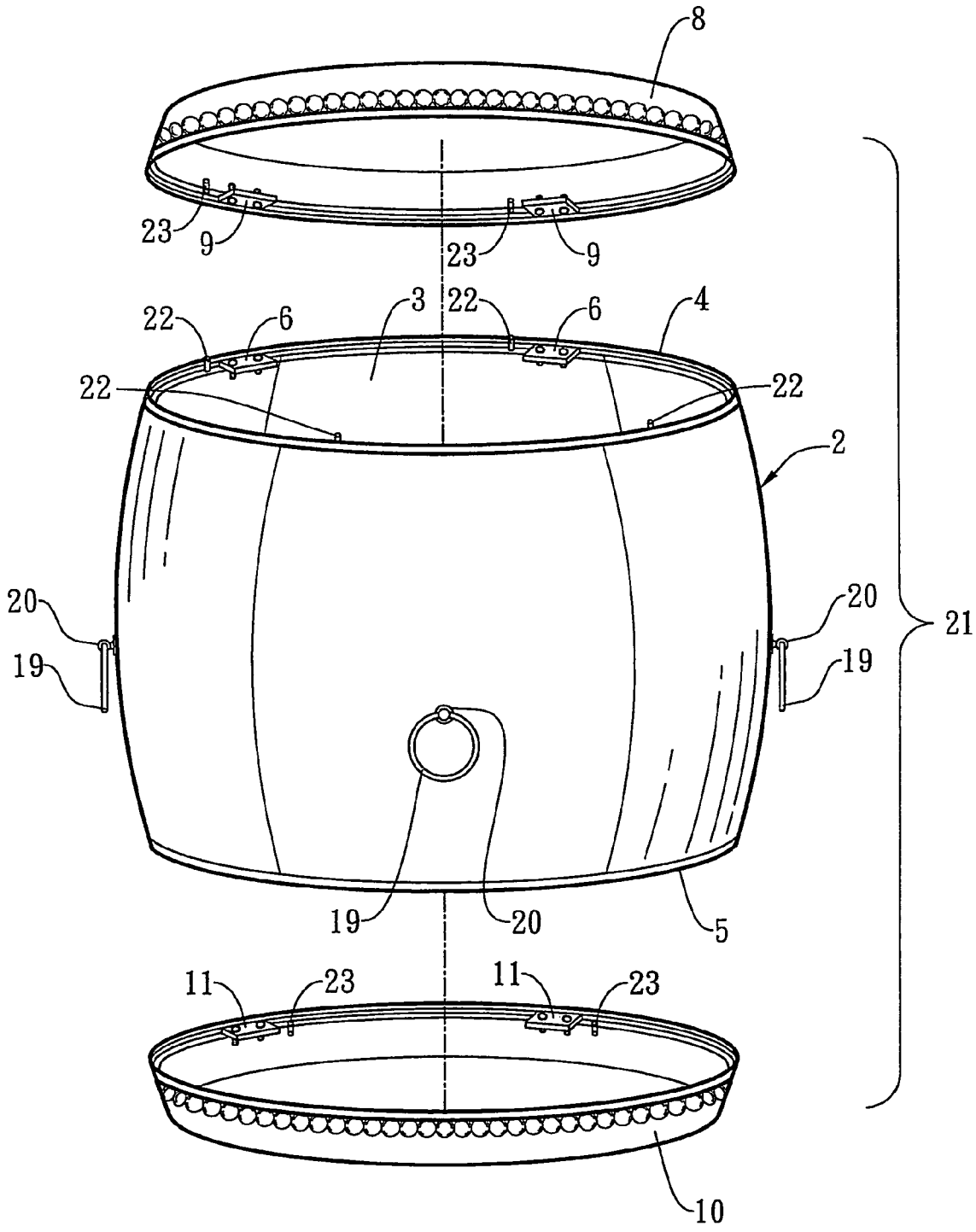
FIG. 4 shows an exploded view of a drum according to a second embodiment of the present invention.
Figure 4B:
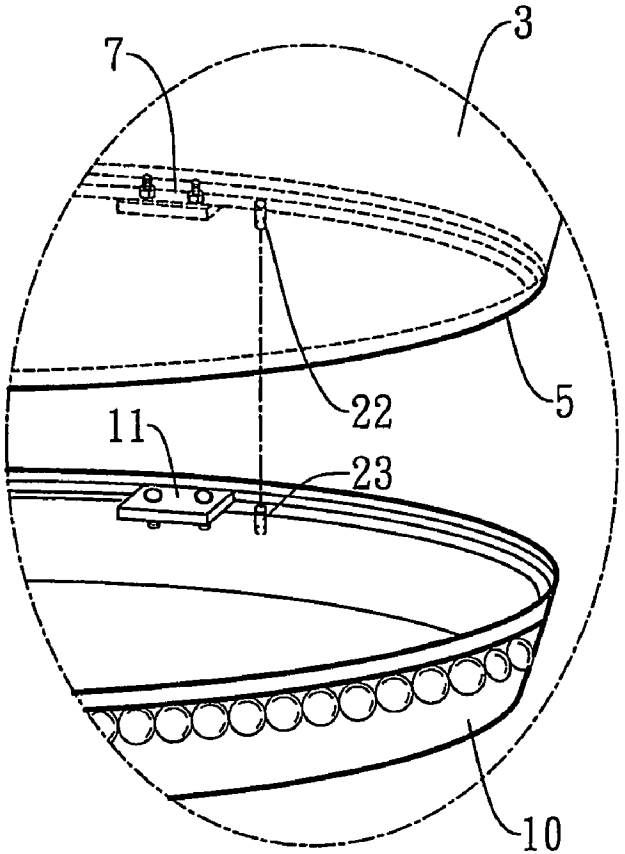
FIG. 4B shows a schematic view of joining the second drumhead with the shell according to the second embodiment of the present invention.
Figure 4A:
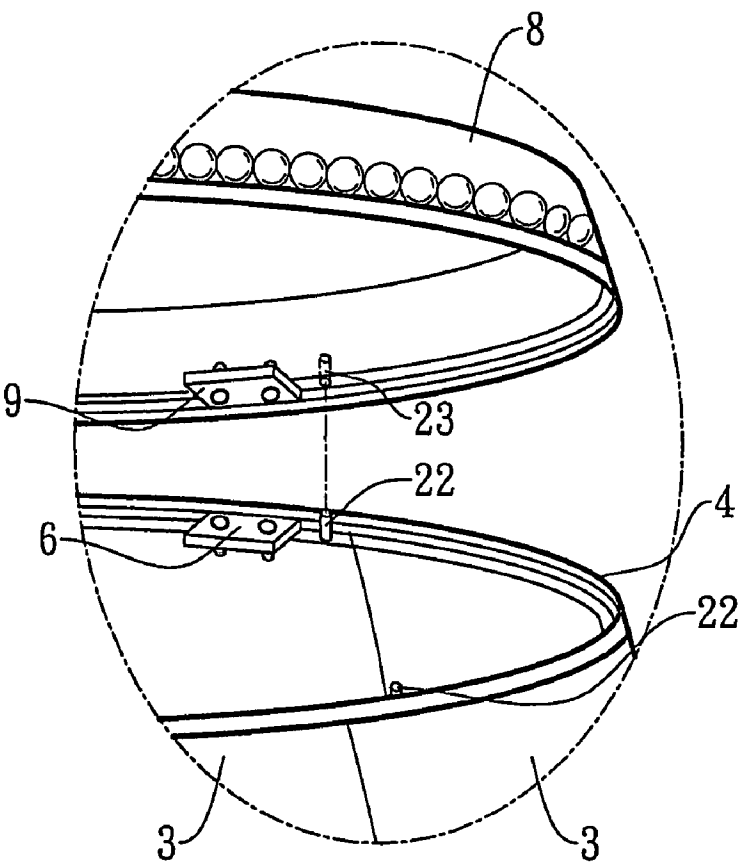
FIG. 4A shows a schematic view of joining the first drumhead with the shell according to the second embodiment of the present invention.
Figure 5:
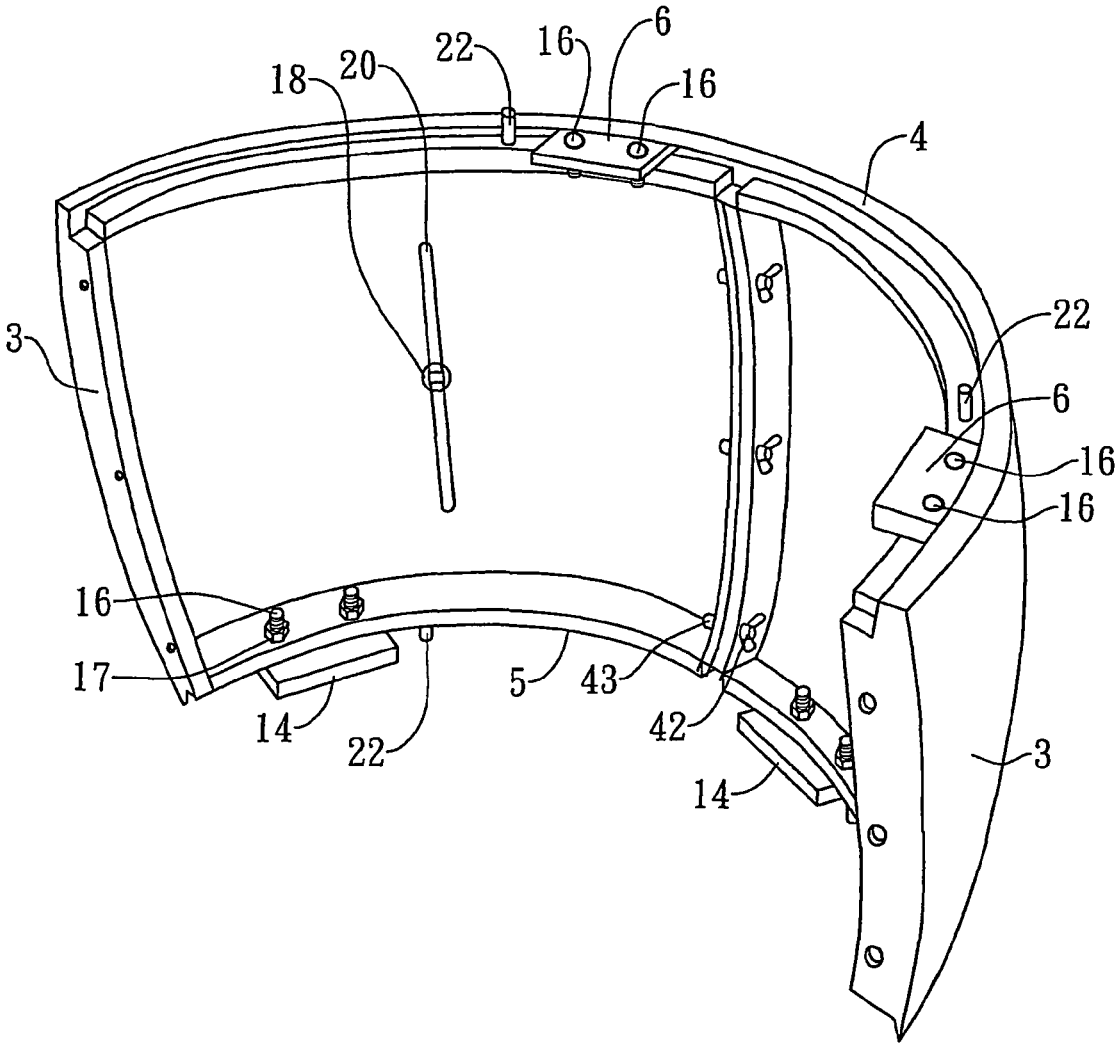
FIG. 5 shows a schematic view of assembling the shell members according to the second embodiment of the present invention.

Reference is now made to FIGS. 4, 4A, 4B and 5, all of which illustrate a drum 21 according to a second embodiment of the present invention. FIG. 4 shows an exploded view of the drum 21; FIG. 4A shows a schematic view of joining the first drumhead 8 with the shell 2; FIG. 4B shows a schematic view of joining the second drumhead 10 with the shell 2; FIG. 5 shows a schematic view of assembling the shell members 3 into the drum 21. In this embodiment, each of the upper rim 4 and the lower rim 5 is provided with at least one securing post 22 respectively, and each of the first drumhead 8 and the second drumhead 10 is provided with a corresponding securing hole 23. The securing posts 22 together with the securing holes 23 help to secure the entire drum construction. The rest of the parts of the drum 21 in the second embodiment are substantially identical to those of the drum 1 in the first embodiment, and hence, further details are to be omitted herein.

Figure 6:
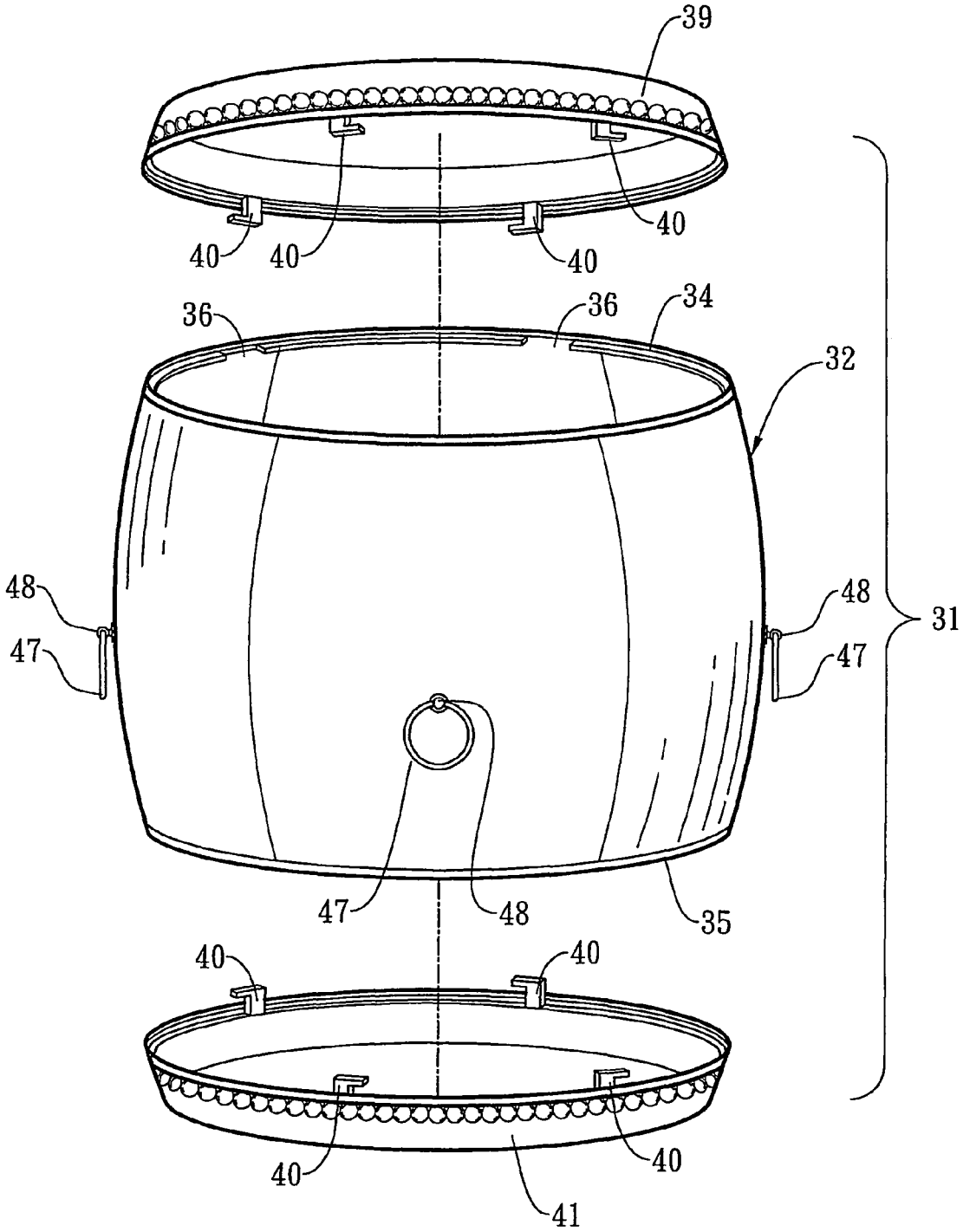
FIG. 6 shows an exploded view of a drum according to a third embodiment of the present invention.
Figure 6B:
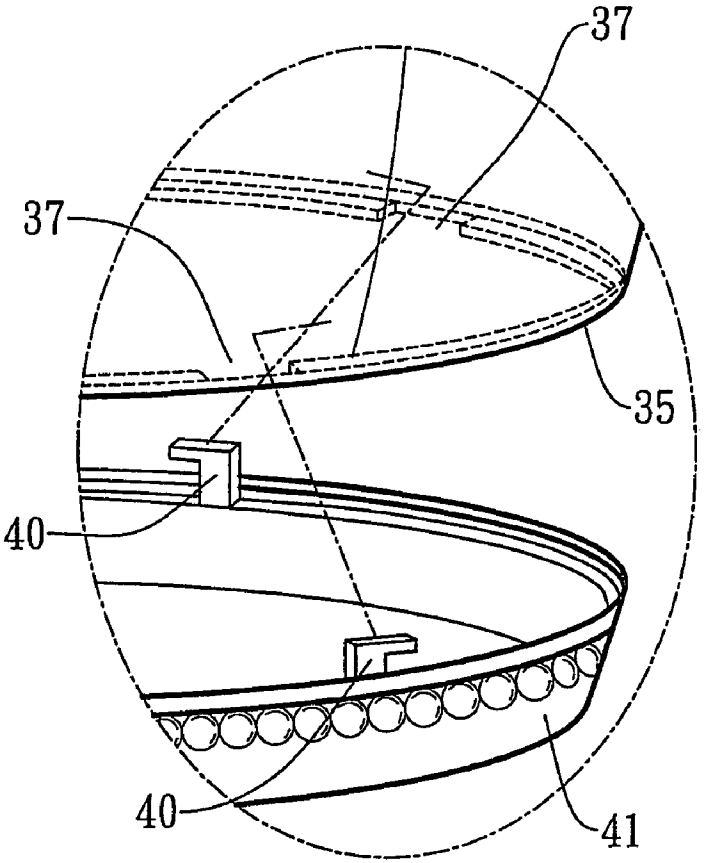
FIG. 6B shows a schematic view of joining the second drumhead with the shell according to the third embodiment of the present invention.
Figure 6A:
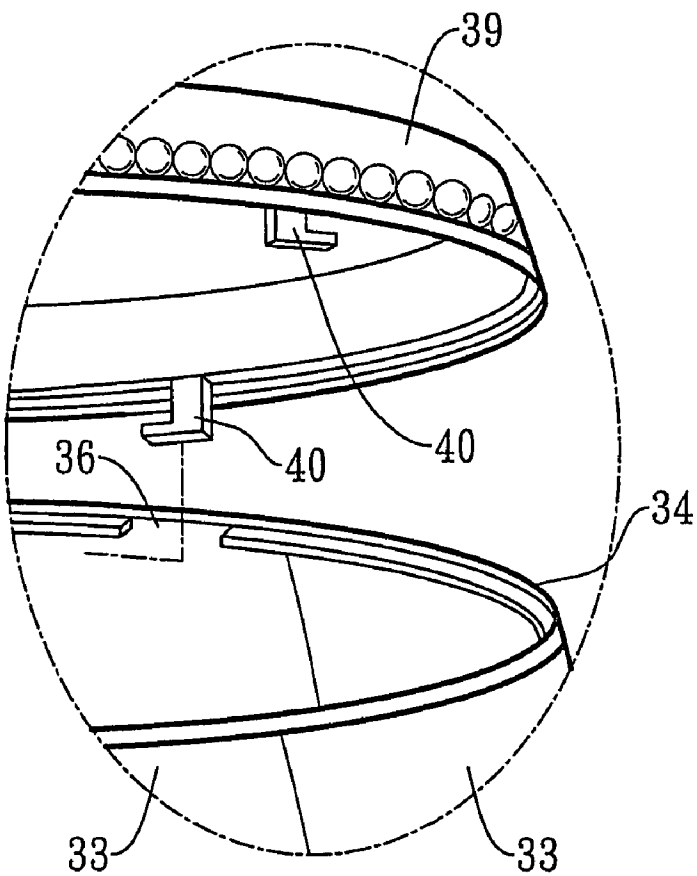
FIG. 6A shows a schematic view of joining the first drumhead with the shell according to the third embodiment of the present invention.

Reference is now made to FIGS. 6, 6A and 6B, all of which illustrate a drum 31 according to a third embodiment of the present invention. FIG. 6 shows an exploded view of the drum 31; FIG. 7A shows a schematic view of joining the first drumhead 39 with the shell 32; FIG. 4B shows a schematic view of joining the second drumhead 41 with the shell 32. In this embodiment, the drum 31 of the present invention comprises a shell 32, a first drumhead 39 and a second drumhead 41. The shell 32 has a plurality of shell members 33. Each shell member 33 can be joined with one another, and the cylindrical shell 32 can be formed when all of the shell members 33 are assembled together. Moreover, the shell 32 has an upper rim 34 provided with at least one first opening 36, and a lower rim 35 provided with at least one second opening 37. The first drumhead 39 is provided with an L-shaped rod 40 corresponding in location to the first opening 36 of the shell 32, and the second drumhead 41 is also provided with an L-shaped rod 40 corresponding in location to the second opening 37 of the shell 32.

Figure 7:
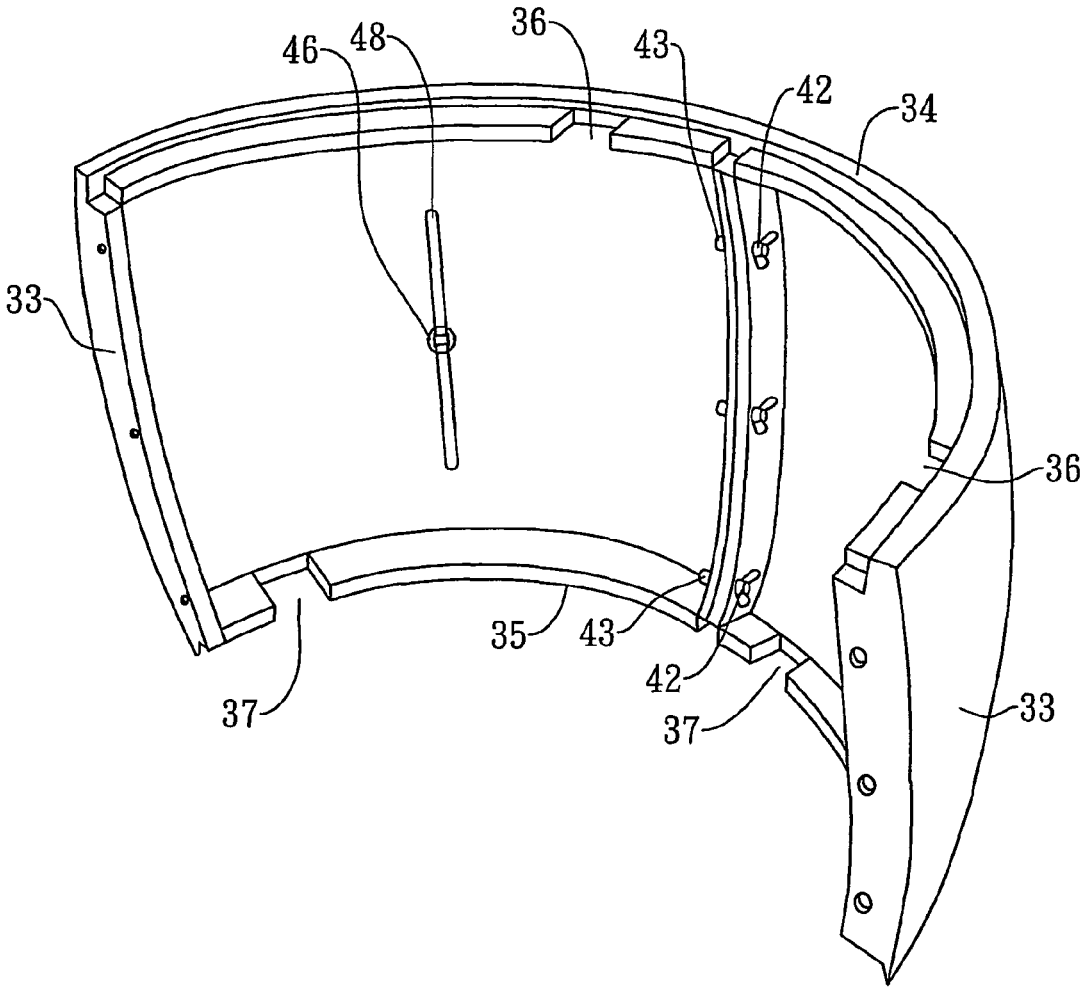
FIG. 7 shows a schematic view of assembling the shell members according to the third embodiment of the present invention.

Referring to FIG. 7 along with FIG. 6, FIG. 7 shows a schematic view of assembling the shell members 33 of the drum 31 according to the third embodiment of the present invention. The shell members 33 use a first joining component 42 and a second joining component 43 to be joined with one another and form the shell 32 together. When a user covers the upper rim 34 with the first drumhead 39 and rotates it a bit, the L-shaped rod 40 can be secured to the first opening 36. Similarly, when the user covers the lower rim 35 with the second drumhead 41 and rotates it a bit, the L-shaped rod 40 can be secured to the second opening 37. Consequently, the first drumhead 39, the second drumhead 41 and the shell 32 can be joined together to form the drum 31 of the present invention.

Each shell member 33 is provided with an aperture 46, and the drum 31 of the present invention further comprises a ring 47 and a foldable sheet 48. The foldable sheet 48 pierces through the ring 47 first and then through the aperture 46 so that the ring 47 can be fixed outside the aperture 46 of the shell member 33.

Figure 8:
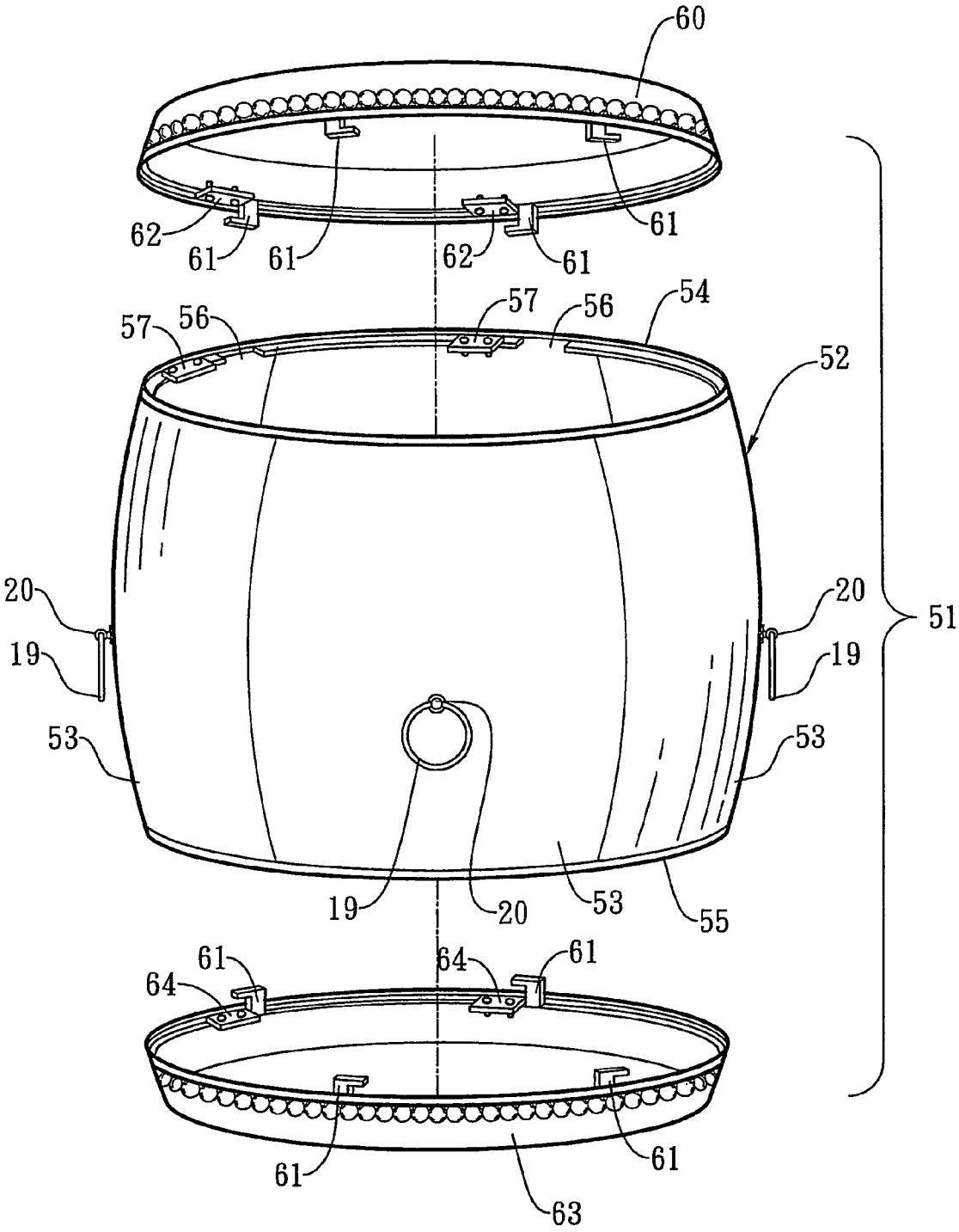
FIG. 8 shows an exploded view of a drum according to a fourth embodiment of the present invention.
Figure 8B:
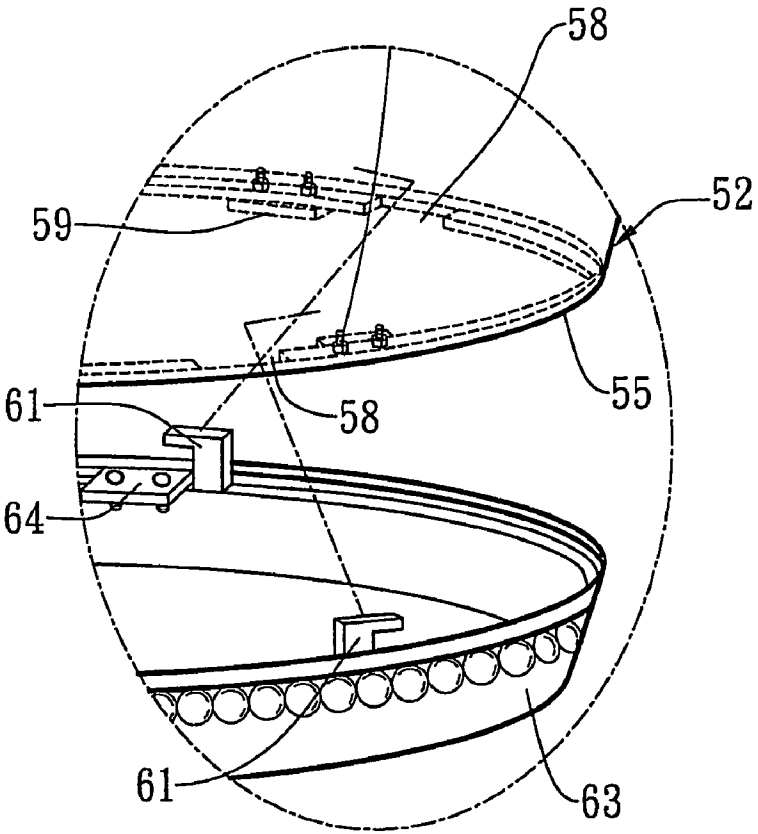
FIG. 8B shows a schematic view of joining the second drumhead with the shell according to the fourth embodiment of the present invention.
Figure 8A:
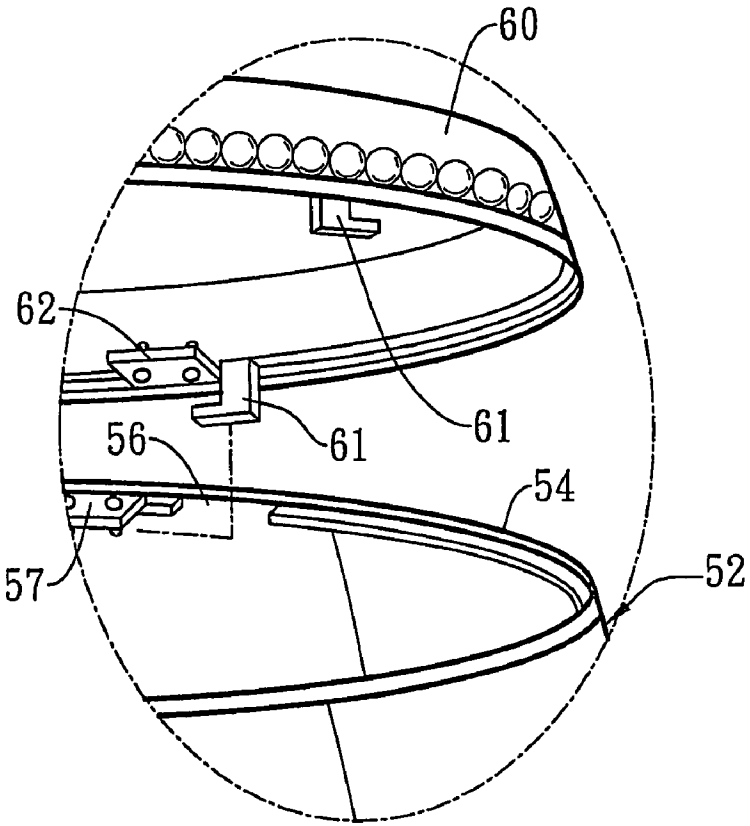
FIG. 8A shows a schematic view of joining the first drumhead with the shell according to the fourth embodiment of the present invention.

Reference is now made to FIGS. 8, 8A and 8B, all of which illustrate a drum 51 according to a fourth embodiment of the present invention. FIG. 8 shows an exploded view of the drum 51; FIG. 8A shows a schematic view of joining the first drumhead 60 with the shell 52; FIG. 8B shows a schematic view of joining the second drumhead 63 with the shell 52. In this embodiment, the drum 51 of the present invention comprises a shell 52, a first drumhead 60 and a second drumhead 63. The shell 52 has a plurality of shell members 53. Each shell member 53 can be joined with one another, and the cylindrical shell 52 can be formed when all of the shell members 53 are assembled together. The shell 52 includes an upper rim 54 and a lower rim 55. The upper rim 54 is provided with at least one first opening 56, close to which at least one first magnetic component 57 is provided, and the lower rim 55 is provided with at least one second opening 58, close to which at least one second magnetic component 59 is provided. The first drumhead 60 is provided with an L-shaped rod 61 corresponding in location to the first opening 56 of the shell 52, and close to the L-shaped rod 61, a third magnetic component 62 is provided. The second drumhead 63 is also provided with an L-shaped rod 61 corresponding in location to the second opening 58 of the shell 52, and close to the L-shaped rod 61, a fourth magnetic component 64 is provided.

The shell members 53 use a first joining component 42 and a second joining component 43 to be joined with one another and form the shell 52 together (as shown in FIG. 3). When a user covers the upper rim 54 of the shell 52, the lower rim 55 of the shell 52 respectively with the first drumhead 60 and the second drumhead 63, and rotates the drumheads 60, 63 a bit, the L-shaped rods 61 can be secured to the first opening 56 and the second opening 58. Further, by magnetism between the first magnetic component 57 and the third magnetic component 62, and also by magnetism between the second magnetic component 59 and the fourth magnetic component 64, the first drumhead 60, the second drumhead 63, and the shell 52 can be joined with one another.

Each shell member 53 of the drum 51 in this embodiment further comprises an aperture 18, a ring 19 and a foldable sheet 20, all of which are identical to those of the drum 1 in the first embodiment (referring to FIGS. 1 and 3), and hence, further details are to be omitted herein.

Figure 9:
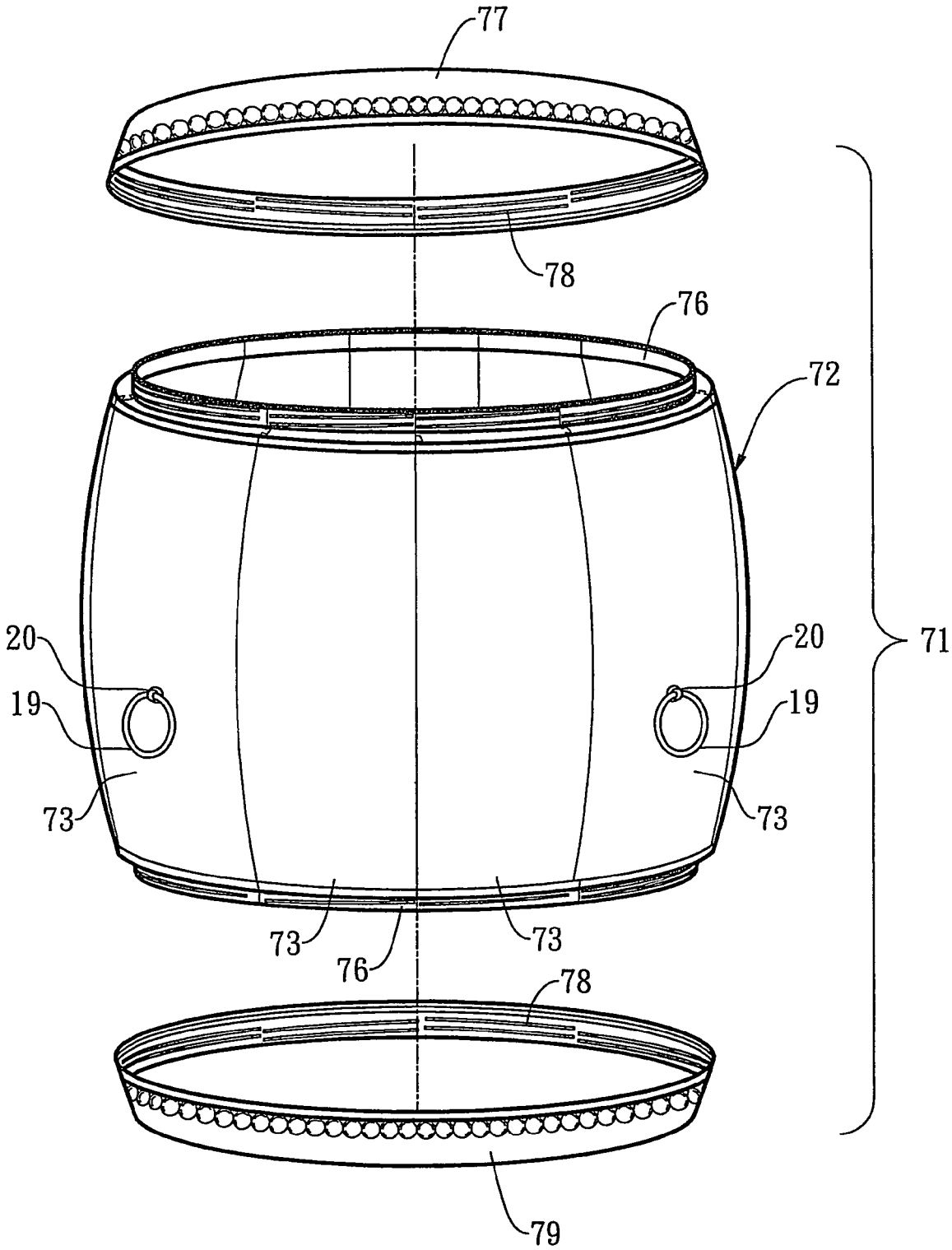
FIG. 9 shows an exploded view of a drum according to a fifth embodiment of the present invention.
Figure 9B:
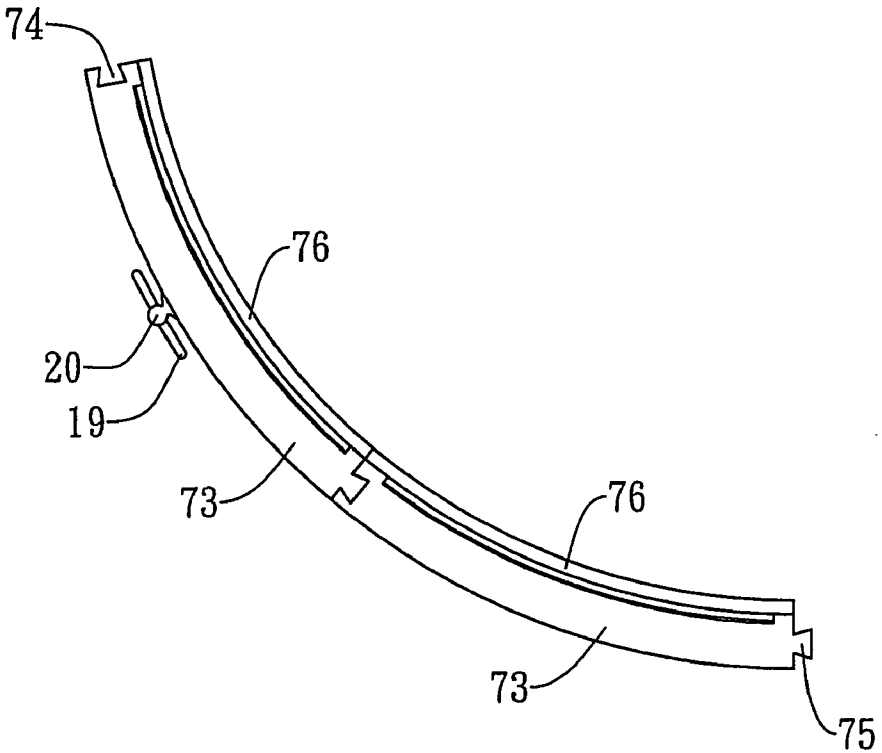
FIG. 9B shows a top view of two shell members according to the fifth embodiment of the present invention.
Figure 9A:
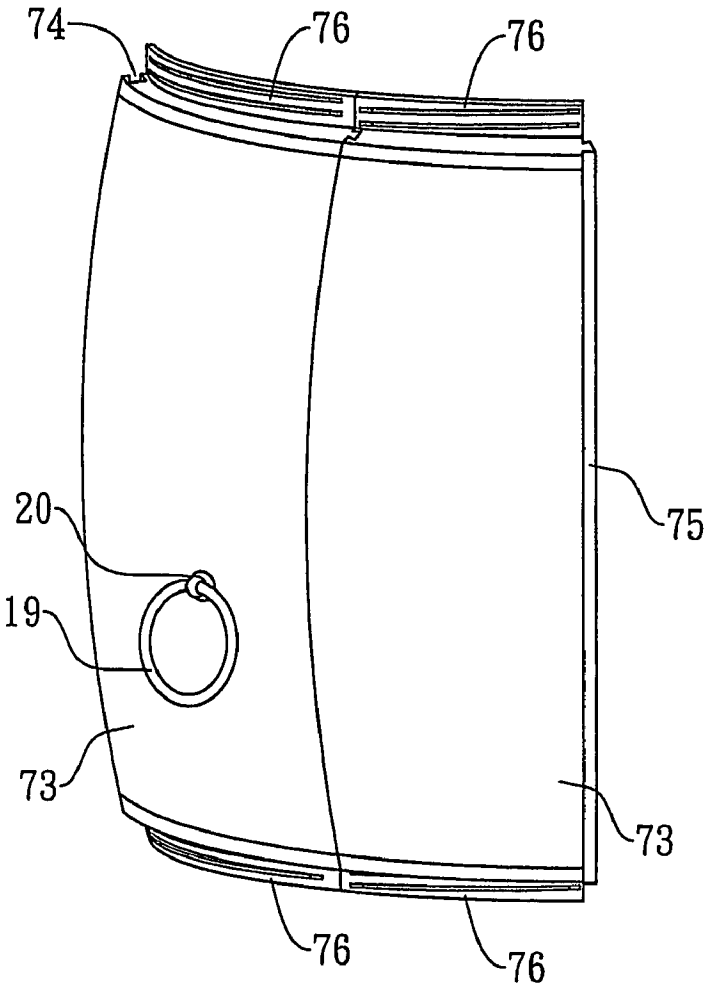
FIG. 9A shows a perspective view of two shell members according to the fifth embodiment of the present invention.
Figure 10:
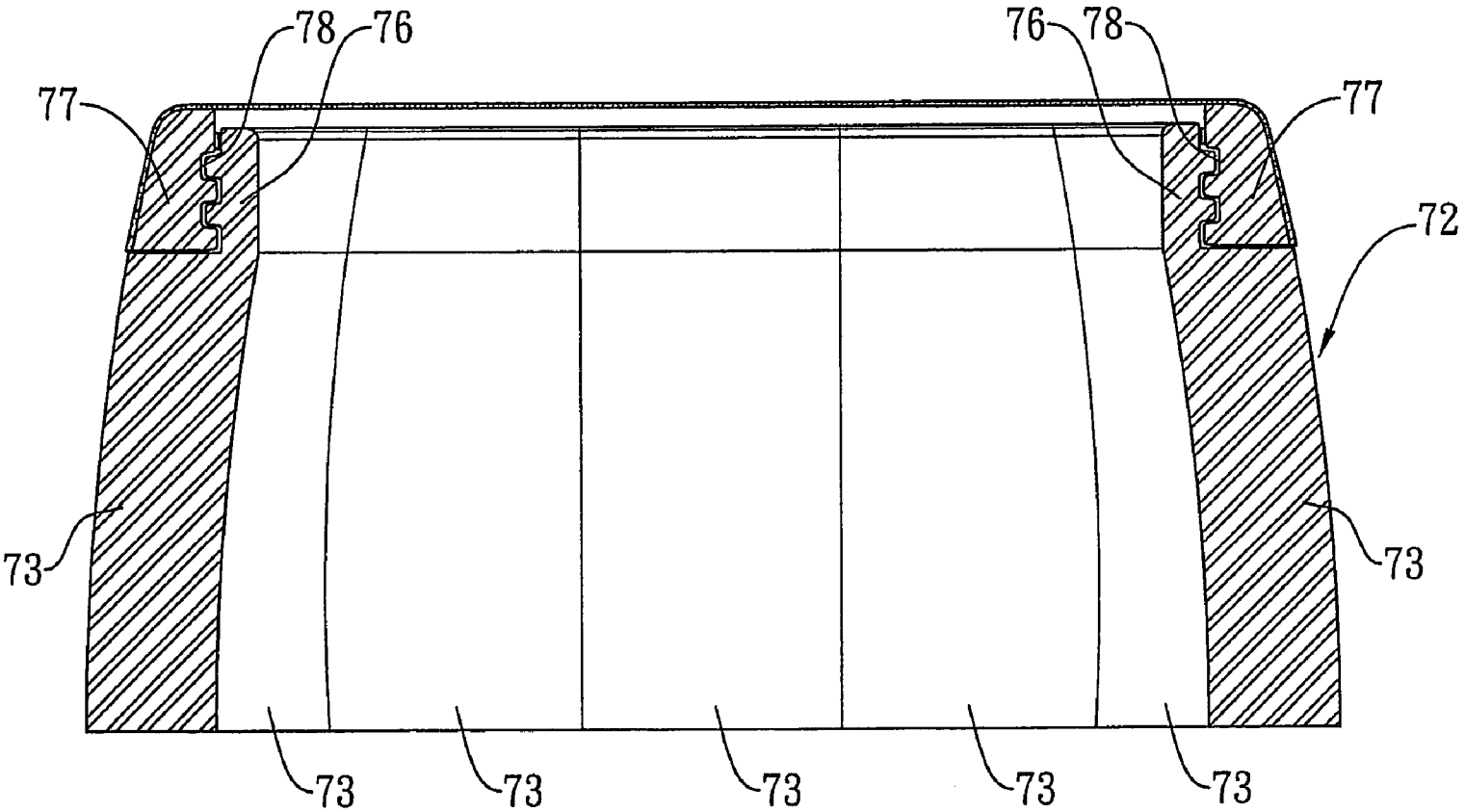
FIG. 10 shows a sectional view of the first drumhead and the shell members according to the fifth embodiment of the present invention.

Reference is now made to FIGS. 9, 9A, 9B and 10, all of which illustrate a drum 71 according to a fifth embodiment of the present invention. FIG. 9 shows an exploded view of the drum 71; FIG. 9A shows a perspective view of shell members 73; FIG. 9B shows a top view of the shell members 73; FIG. 10 shows a sectional view of a first drumhead 77 joined with the shell members 73. The drum 71 according to the fifth embodiment of the present invention comprises a shell 72, a first drumhead 77 and a second drumhead 79. The shell 72 comprises a plurality of shell members 73. Each shell member 73 is provided with a dovetail slot 74 and a dovetail protrusion 75 at two opposite ends, and is provided with male threads 76 at another two opposite ends. The inner wall of the first drumhead 77 is provided with a female thread 78 corresponding to the male thread 76 of each shell member 73. The inner wall of the second drumhead 79 is provided with another female thread 78 corresponding to the male thread 76 of each shell member 73.

Each shell member 73 can be joined with one another by coupling the dovetail slot 74 to the dovetail protrusion 75, and the cylindrical shell 72 can be formed when all of the shell members 73 are assembled together. Furthermore, the female thread 78 of the first drumhead 77 is coupled to the male thread 76 of the shell member 73, while the female thread 78 of the second drumhead 79 is coupled to the male thread 76 of the shell member 73. In consequence, the first drumhead 77, the second drumhead 79 and the shell 72 can be joined together with one another.

Each shell member 73 of the drum 71 in this embodiment further comprises an aperture 18, a ring 19 and a foldable sheet 20, all of which are identical to those of the drum 1 in the first embodiment (referring to FIGS. 1 and 3), and hence, further details are to be omitted herein.

A drum of the present invention is advantageous in that it is easy to assemble and disassemble the drum, and accordingly, it is highly convenient whether to carry or to transport the drum.

While this invention has been described by way of examples and in terms of preferred embodiments, it is to be understood that this invention is not limited hereto, and that various changes, substitutions, and alterations can be made herein without departing from the spirit and scope of this invention as defined by the appended claims.

What is claimed is:

1. A drum, comprising:

a shell having a plurality of shell members, wherein each shell member can be joined with one another to form the cylindrical shell, which has an upper rim provided with at least one first magnetic component and a lower rim provided with at least one second magnetic component;

a first drumhead provided with a third magnetic component which corresponds in location to the first magnetic component of the shell so that the two magnetic components can be coupled together; and a second drumhead provided with a fourth magnetic component which corresponds in location to the second magnetic component of the shell so that the two magnetic components can be coupled together, wherein the shell members use a first joining component and a second joining component to be joined with one another so as to form the shell, and wherein by magnetism between the first magnetic component and the third magnetic component and magnetism between the second magnetic component and the fourth magnetic component, the first drumhead, the second drumhead and the shell can be joined with one another.

2. The drum of claim 1, wherein the first magnetic component and the second magnetic component are provided with a securing post each, wherein the third magnetic component is provided with a securing hole corresponding to the securing post of the first magnetic component, and wherein the fourth magnetic component is provided with a securing hole corresponding to the securing post of the second magnetic component.

3. The drum of claim 1, wherein the upper rim and the lower rim of the shell are provided with a securing post each, and wherein the first drumhead and the second drumhead are provided with a securing hole corresponding to the securing post of the shell each.

4. The drum of claim 1, wherein the first magnetic component and the third magnetic component are both magnets.

5. The drum of claim 1, wherein the second magnetic component and the fourth magnetic component are both magnets.

6. The drum of claim 1, wherein the first magnetic component is secured at the upper rim of the shell through the use of a third joining component along with a fourth joining component, and wherein the second magnetic component is secured at the lower rim of the shell through the use of the third joining component along with the fourth joining component.

7. The drum of claim 1, wherein the shell member is provided with an aperture.

8. The drum of claim 7, further comprising a ring and a foldable sheet, wherein the foldable sheet pierces through the ring first and then through the aperture so that the ring can be fixed outside the aperture of the shell member.

9. The drum of claim 1, the shell further comprises a first opening and a second opening, and the first drumhead is further provided with an L-shaped rod which corresponds in location to the first opening of the shell; and the second drumhead is further provided with an L-.shaped rod which corresponds in location to the second opening of the shell, wherein the L-shaped rods can be secured to the first and second openings respectively so that the first drumhead, the second drumhead and the shell can be joined with one another.

10. The drum of claim 1, wherein the first joining is a dovetail slot and the second joining component is a dovetail protrusion, therefore the shell members are joined with one another so as to form the shell.

* * * * *